United States Patent [19]

Drinkard et al.

[11] 4,076,078

[45] Feb. 28, 1978

[54] PROCESS FOR FORMING A COALATE SOLUTION IN-SITU

[75] Inventors: Gary Drinkard, Houston; William A. McLaughlin, Bellaire, both of Tex.

[73] Assignee: Shell Oil Company, Houston, Tex.

[21] Appl. No.: 716,906

[22] Filed: Aug. 23, 1976

[51] Int. Cl.[2] ..... E21B 43/24; E21B 43/28

[52] U.S. Cl. ..... 166/271; 166/272; 166/266

[58] Field of Search ..... 166/271, 272, 303, 307, 166/261, 259, 263, 265–267; 299/5, 4; 48/DIG. 6, 210; 208/8; 241/1; 44/1 B, 51

[56] References Cited

U.S. PATENT DOCUMENTS

| | | | |
|---|---|---|---|
| 1,532,826 | 4/1925 | Lessing | 299/5 |
| 2,813,583 | 11/1957 | Marx et al. | 166/271 |
| 3,734,184 | 5/1973 | Scott | 166/259 |
| 3,775,073 | 11/1973 | Rhoades | 166/259 X |
| 3,815,826 | 6/1974 | Aldrich et al. | 241/1 |
| 3,850,477 | 11/1974 | Aldrich et al. | 299/5 |
| 3,858,654 | 1/1975 | Walker | 166/272 X |
| 3,973,628 | 8/1976 | Colgate | 299/5 X |

OTHER PUBLICATIONS

Dryden, "Solvent Power for Coals at Room Temperature", Chemistry and Industry, 6-7-52, pp. 502–508.

*Primary Examiner*—Stephen J. Novosad

[57] ABSTRACT

This invention is a process for mining an underground formation of coal having high oxygen content by contacting the coal with a heated basic aqueous solution for a time sufficient to dissolve at least a portion of the coal formation to produce a coalate. Periodically or continuously, some of the dissolved material is removed to facilitate or improve access to the coal formation. The dissolved coal or coalate is then treated with a regenerating agent to recover basic aqueous solution from the coalate.

14 Claims, 2 Drawing Figures

PROCESS FOR FORMING A COALATE SOLUTION IN-SITU

BACKGROUND OF THE INVENTION

1. Field of the Invention

This invention relates to a process for mining coal with a heated basic aqueous fluid to form coalate, and removing the coalate from the coal formation.

2. Prior Art

It is generally known that coal is removed from the ground using two methods, either strip mining, in which the coal is merely dug out of the ground by mechanical or hydraulic means and transferred to the place of use, or underground mining using methods such as slurry mining (see U.S. Pat. No. 3,260,548 to Reichl), room and pillar, or longwall. The means for taking the coal out of the ground in the room and pillar or longwall methods are generally mechanical cutters, rippers, planers, loaders, etc. In slurry mining hydraulic apparatus is used to direct pressurized water at the coal seam to disaggregate the coal and form a slurry which is then pumped out of the mine to the surface. In all of these coal mining techniques it is first necessary to loosen the coal from the formation using some means such as explosives, hydraulic pressure, or physically contacting the coal with cutters, etc., before the coal can be transported away from the mine and to the place of use. Such methods require much time and large capital outlays for expensive loosening equipment.

Attempts have been made in the coal industry to find an agent which would attack the coal in such a way that the bonds between the coal constituents would be weakened and mechanical separation of the coal could be facilitated. Such a process is taught by U.S. Pat. No. 1,532,826 to Lessing, wherein the coal is treated with an acid or an aryl amine to facilitate mechanical segregation of the coal. Although such an acid treatment facilitates disaggregation by mechanical means the treatment does not result in complete disaggregation of the coal. Somewhat greater disaggegation of coal by solutions containing sodium hydroxide, among other constituents, is taught by U.S. Pat. No. 3,815,826 to Aldrich et al.

It has now been discovered that by contacting a coal formation of high oxygen content coal with a heated basic aqueous solution, particularly sodium hydroxide, the coal can be substantially dissolved. Although it has been generally known that finely ground bituminous coal can be treated with an aqueous alkali solution at elevated temperatures to obtain a coke-like residue, and that the hydrogenation of these residues forms products which are more hydrocarbon-like in nature than does a similar hydrogenation of the coal itself, (see for example "Action of Aqueous Alkali on a Bituminous Coal" by Leo Kasehagen in Industrial and Engineering Chemistry, May, 1937), it was surprising indeed to discover that coal of relatively high oxygen content may be mined when contacted with a heated basic aqueous solution and dissolved in situ. This phenomena can be utilized to remove a complete coal formation more easily than the coal could be mechanically removed or removed by slurry mining. Further, the basic aqueous solution can be regenerated with an agent such as an acid or base.

SUMMARY OF THE INVENTION

Broadly, this invention is a process for dissolving subterranean coal of high oxygen content which comprises contacting said coal with a heated basic aqueous solution, preferably sodium hydroxide, for a time sufficient to dissolve the coal. This invention can also be used to dissolve subterranean coal in beds which outcrop from the surface of the earth. It will be appreciated that, when the process of this invention is used to recover coal from an underground formation, it is preferred to first penetrate the coal bed with at least one borehole, then pump the heated basic aqueous solution down the borehole to contact the underground seam of coal. Either periodic or continuous enlargement of the wellbore in the vicinity of alkali injection by removal of some of the dissolved coal is necessary to continue dissolution of the coal.

The heated basic aqueous solution is maintained in contact with the coal for a time sufficient to substantially dissolve said coal. The coal thus dissolved can then be transported to a receiving terminal, preferably above ground, either by mechanical means or by application of pressure to the coalate in the mine.

In another aspect of this invention, after the coalate has been removed to the surface or another convenient location, the aqueous base is regenerated with an acid or base.

DETAILED DESCRIPTION OF THE INVENTION

Figure 1:
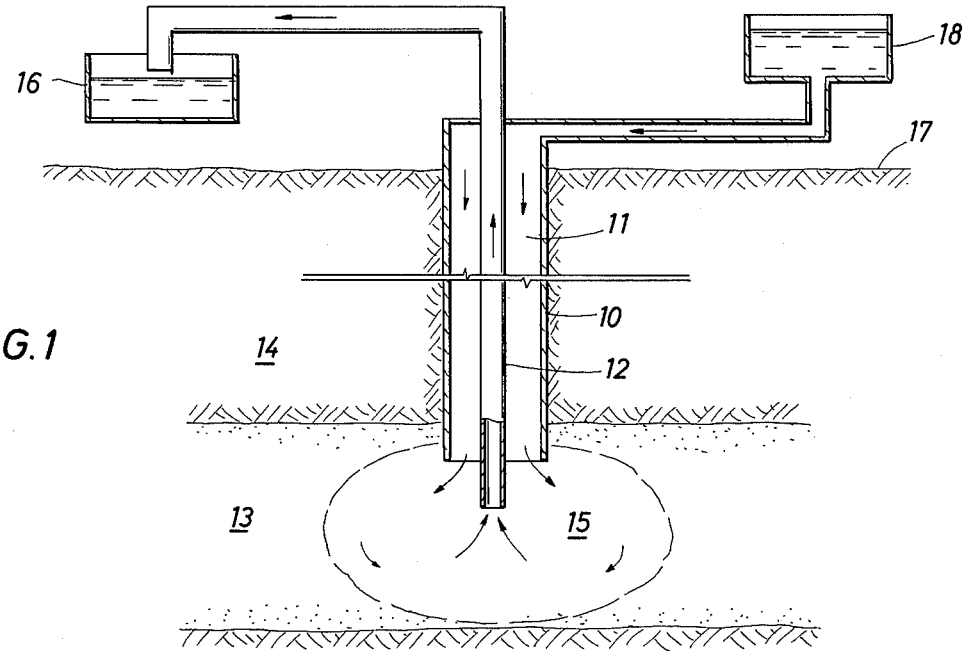
FIG. 1 is a simplified diagram of the cross section of a single borehole communicating between the surface of the earth and a coal seam.

In its broadest aspect, the process of the instant invention pertains to the dissolution of relatively high oxygen content coal in situ and removal from the coal seam. Coal generally refers to the commonly known substance which is a solid, brittle, more or less distinctly stratified, combustible carbonaceous rock, which has been formed by partial-to-complete decomposition of vegetation over a period of many years, and varies in color from dark brown to black. Coal is entirely different from oil shale or tar sand. The coal is generally not fusible without decomposition, and has limited solubility in most solvents. The types of coal which can be dissolved, using the process of this invention, include all coals of high oxygen content, such as lignite, sub-bituminous, bituminous of various classifications, i.e., low, medium, and high rank bituminous; semi-bituminous coal, semi-anthracite, anthracite, and super-anthracite coal. Generally it is found that the process is particularly useful for sub-bituminous coal of high oxygen content, especially those deposits found in Western U.S., such as in the Big Horn Mine, WY.

While it is not completely understood how contacting with heated basic aqueous solutions such as caustic solutions causes high oxygen content coal to substantially dissolve, and it is not desired to be bound by any particular theory, it is though that the primary cause of the reaction is the dissolution of constituents of the coal which behave like humic acids. That is, humic acid-like material of the coal, which has been formed from vegetable matter, is more subject to attack by the basic solution than others. The basic solution dissolves this material, thus forming channels within the coal, ultimately weakening the binding and the adhesion between the coal constituents, and causing the coal to substantially dissolve.

The heated basic aqueous solution contemplated for use in the process of the invention is a water solution of a basic substance, i.e., a substance which, when added to water, will increase the hydroxide ion concentration of the water. Generally, this includes many oxides and hydroxides such as those of the alkaline metals, i.e., sodium, lithium, potassium, and the like. Of these sodium hydroxide is particularly preferred. Other heated basic aqueous solutions such as alkaline carbonates or bicarbonates, e.g., sodium carbonate and sodium bicarbonate, may also be used in the process of this invention, but with a lesser degree of effectiveness. The solutions useful in the process of this invention vary in strength from a lower range of about 0.5 percent by weight (% w) of the basic substance, and preferably 2% w, to an upper range of about 20% w, preferably about 5% w, depending on solubilities of the basic substance. It appears that generally the amount of basic substance needed to effectively dissolve the coal will range from about a lower limit of 0.2 part up to about 1 part by weight of the basic substance per part by weight of coal, and not much advantage is gained by exceeding about 0.3 parts base per part coal.

Generally, it is found that the effectivenss of the treatment of high oxygen content coal increases with increasing temperature, that is, the coal dissolves more completely in a given time period as the temperature increases. Thus, the temperature range over which the coal can be treated with the heated basic aqueous solution extends substantially over a range of temperatures from about 175° C to substantially higher, depending of course upon pressures employed. For the more practical pressures envisioned, this temperature range is approximately from 175° to 250° with 200° C being about optimal for Big Horn coal. At 250° C it is necessary to go to special materials of construction such as Hastelloy and similar corrosion resistant materials which reduce the economic attractiveness of the process.

The length of time which the basic aqueous solution must be held in contact with the coal appears to depend upon the type of coal, as well as the strength and temperature of the basic solution. Generally, the more concentrated and heated the base is, the faster the dissolution will be, and generally the process is most effective on high oxygen content sub-bituminous and bituminous type coals. Generally, at the base/coal ratios given above, it is found that the contact time will be less than 48 hours and preferably less than 12 hours but more than 1 hour.

The pressure at which the reaction is carried out can be atmospheric, sub-atmospheric, or super-atmospheric. However it is preferred to use a pressure which is atmospheric or above depending on the depth of the coal formation being treated. Pressure should be adequate to prevent formation fluid invasion and interruption of solution injection. In cases where no communication with outside fluids exists it may be desirable to maintain sufficient pressure to support overburden and prevent collapse into the process zone.

The gaseous environment in which the coal is treated may be inert or reactive, but is preferably inert, i.e., an environment which does not substantially react with the coal, such as nitrogen or methane.

Although, as pointed out above, the process of this invention comprises dissolving a coal bed that is below the surface of the ground by contacting with a basic aqueous solution, if the basic aqueous solution is used to treat a bed of coal that outcrops at the surface of the earth, i.e., an open pit mine, coal can be dissolved completely by treatment with the basic aqueous solution and is therefore more readily removable.

The coal can be contacted in any of the methods known in the art. For instance, if the coal is in an open pit mine, the basic aqueous solution can merely be poured or pumped to the exposed surface of the coal and allowed to contact the coal until it dissolves sufficiently to be removed. The dissolution can be speeded up by circulating the basic aqueous solution over the surface of the coal. It is also foreseen that heated basic aqueous solution could be sprayed onto the coal at hydraulic pressures sufficient to assist in the dissolution of the coal.

The basic aqueous solution can be regenerated by several routes. For example, if heated aqueous sodium hydroxide were utilized to form liquid sodium coalate, the sodium hydroxide can be regenerated by reacting the sodium coalate with $CO_2$ gas or carbonic acid to form acid coalate. Generally, strong acids such as nitric, sulfuric, hydrochloric, etc. work better than weaker acids such as carbonic, acetic, etc. Instead of an acid, another base may be utilized to regenerate the basic aqueous solution employed to form the coalate. Again taking sodium coalate as an example, sodium hydroxide can be regenerated therefrom by reacting the sodium coalate with calcium hydroxide to form calcium coalate and sodium hydroxide. Other bases such as barium hydroxide and magnesium hydroxide work well, as do all of the oxide and hydroxides of the alkaline metals. Other materials may precipitate the coalate without regenerating the basic aqueous solution. For example, calcium chloride (or some other metal halide) will precipitate calcium coalate but produce sodium chloride instead of the more desired sodium hydroxide.

Reference is made in the following discussion to FIG. 1 for the purposes of further explaining the process of this invention but not in a limiting manner. Where the coal lies beneath the earth's surface 17, it is preferred to carry out the process of this invention by penetrating the overburden 14 and the coal seam 13 so that communication is established between the surface and the coal seam. The penetration of the coal bed is generally done by any known methods of drilling and establishing a borehole 10 communicating between the earth's surface 17 and the coal formation 13 underground. When communication has been established, the heated basic aqueous solution from storage 18 is passed through the borehole 10 and into contact with the coal bed 13. This can be done merely by pumping the heated basic aqueous solution through the well borehole so that the solution contacts the coal at the lower end of the borehole. To increase initial contact, a cavern 15 may be formed around the underground end of the well borehole, by explosive means, hydraulic pressure, or mechanical means known in the art, so that more surface area of the coal is exposed to the heated basic aqueous solution when it is pumped down. In order to increase the contact of the heated basic aqueous solution with the surface of the coal even more, the formation may be fractured by any of the conventional methods known in the art, such as hydrofracting, explosive means, nuclear means, etc. Further, if the coal is associated with water-soluble minerals, these minerals can first be dissolved out by passing water through the borehole into contact with the water-soluble minerals, and withdrawing the solution of water-soluble minerals in the water. Thereafter, the heated basic aqueous solution can be pumped down the borehole to contact the exposed coal surfaces. If the water-soluble minerals are base-forming, the heated basic solution formed by injecting heated water may be left in contact with the coal for a time sufficient to dissolve it.

The process of the invention may be carried out by installing a tubing string 12 down the center of borehole 10. The heated basic aqueous solution is pumped down the annular opening 11 into contact with the coal, then the coalate is pumped out of contact through tubing string 12 to the receiving terminal 16. The roles of tubing and the annular opening may be reversed.

Figure 2:
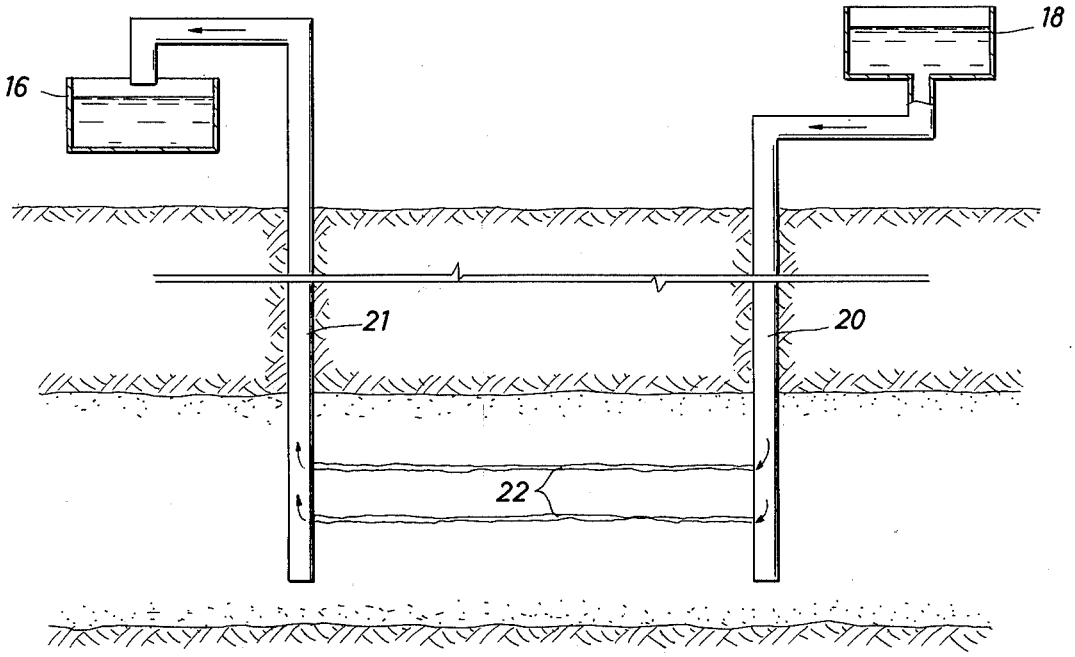
FIG. 2 shows a cross section of a formation penetrated by at least two boreholes.

In some cases it is preferable to penetrate the coal formation with at least two boreholes, as shown in FIG. 2 — one an injection well 20 and the other a production well 21, then fracturing the formation, using conventional means mentioned before, or otherwise creating permeable connections between wells such as drilling or mining, to establish communication between the two wells, and pumping the head basic aqueous solution down the injection well into contact with the coal formation, through the fractures 22 to the production well, and out the production well. The heated basic solution is maintained in contact with the coal for a sufficent time to dissolve the coal. In some cases, it is preferable to penetrate the formation with more than one injection well and more than one production well surrounding the injection wells, establishing communication between the injection wells and the production wells, passing the heated basic solution through the injection wells to the formation and out through the various production wells. This can be done using generally any type of well configuration taught in the prior art such as 5, 7, 9 and 13 spot patterns.

After communication is established between the surface and the coal seam using one of the techniques described above, the coal is contacted with the heated basic aqueous solution for a period of time sufficient to dissolve the coal and form a solution which is then transferred out a tubing string 12 (FIG. 1) or a production well 21 (FIG. 2) to a receiving terminal 16 for further treatment.

It appears that the basic material reacts with the coal to form a coalate solution. It is preferable to attempt to regenerate the basic material or the alkaline metal value from the coal at or near the point at which the coalate is taken from the ground. This may be done by treating the coalate to extract the alkaline metal values prior to extracting energy values from the coalate, or the coalate may be first used to recover energy values and thereafter the alkaline metal may be recovered, e.g. from the remaining ash after burning the coalate to obtain heat values.

This invention will be further explained in detail with reference to the following embodiments which are given in way of illustration only and not by way of limitation.

EXAMPLES

The products from a given batch of Big Horn coal treated with excess sodium hydroxide solution at 250° C were analyzed. Results showed that approximately 85 percent of the dry coal treated was converted to gaseous or water-soluble products and that the undissolved residue contained essentially all of the original coal ash. Humic acid products with an equivalent weight range of 625 ± 50 grams made up most of the dissolved products and when recovered as acid precipitated material had heat contents slightly higher than the original coal. Calcium hydroxide added to solutions of the humic acids resulted in the precipitation of insoluble complexes. The data below were obtained from a single 200 gram moisture-free sample of Big Horn coal treated with approximately 4 molar sodium hydroxide solution.

The coal sample with 600 ml distilled water and 100 grams sodium hydroxide were charged to a one liter, high pressure, Hastelloy 'B', lined reactor. The sealed vessel was then heated in a forced air convection oven at 250° C for 24 hours. After the reaction mixture was cooled, undissolved gases were recovered, and the reactor contents were diluted with water, centrifuged, and the insoluble fraction washed extensively. Combined washings and filtrate were finally diluted to 5,500 ml and are subsequently referred to as the "5,500 ml" solution.

In addition to coal dissolution products the "5,500 ml" solution contained a significant quantity of unreacted sodium hydroxide. The products in solution included $CO_2$ (present as $Na_2CO_3$), sodium humate and the sodium salts of some low molecular weight organic acids.

Undissolved components included a small quantity of gases and an insoluble residue of coal. A material balance for the 200 gram, moisture-free coal sample is shown in Table 1. There is a small uncertainty in the weight of product described as "acid soluble components". These low molecular weight, colorless organic acids (remaining in solution after acid precipitation of humic acids) were estimated by measuring the quantity of non-carbonate carbon in solution. The results were then treated as if all the dissolved carbon were present as acetic acid which is probably the major solution component after removal of humic acid.

Table 1 also shows the small quantity of gases, others than $CO_2$, which were evolved with sodium hydroxide dissolution of the coal. A mass spectrometric analysis of these gases is given in Table 2.

That fraction of the coal sample which was not dissolved by treatment with sodium hydroxide is the 16 percent "insoluble residue" of Table 1. Essentially all the inorganic material in the original coal is contained in this residue. Its ash content is 26.2 percent.

The humic acids yield shown in Table 1 is a mean value for results obtained by three separation methods. These data are given in Table 3. The material recovered is described as 'humus' in Table 3 to indicate the product is free of moisture and ash and has been calculated to a humic acid basis. Analyses for products actually separated by precipitation with hydrochloric acid, carbonic acid, and calcium hydroxide are shown in Tables 4, 5 and 6 respectively.

In the calcium humate separation, Table 6, carbonate present as sodium carbonate in the "5,500 ml" solution was coprecipitated with calcium humate complex. This accounts for the large quantity of ash shown in the product analysis. Calcium content of the ash by atomic absorption analysis was 59.7 percent and sodium content by the same procedure was 1.3 percent indicating 0.32 percent sodium by weight for the unashed calcium humate product. A spectrochemical analysis for the ash of Table 6 is shown in Table 7. The presence of many of the elements seen here reflect the attack of sodium hydroxide on the Hastelloy reactor liner.

Table 8 gives heats of combustion values determined for the insoluble residue, gases and dissolution products from the "5,500 ml" solution. About 76 percent of the recovered heat value is in the humic acids. The heat content is approximately 64 percent of the original moisture-free coal and their heat value per unit weight is slightly more than that of the moisture-free coal; 12,600 Btu/lb for the humic acids vs. 12,370 Btu/lb for moisture-free Big Horn coal.

Total oxygen in the combined dissolution products is about 27 percent by weight. In comparison the oxygen content of moisture-free Big Horn coal is about 16.9 percent. The relatively large quantity of oxygen taken up with sodium hydroxide dissolution offers some explanation for the missing heat in Table 8. The exothermic heat accompanying these hydrolytic reactions is evidently on the order of 2,000 Btu/lb moisture-free coal (16.4 percent of 12,370 Btu/lb = 2,029).

Table 1

APPROXIMATE MATERIAL BALANCE FOR BIG HORN COAL SAMPLE TREATED WITH SODIUM HYDROXIDE (200 GRAM SAMPLE)

| Product | Weight (grams) | % M. F. Sample |
|---|---|---|
| Gases (other than $CO_2$) | 0.02 | 0.01 |
| Insoluble Residue | 33.38 | 16.15 |
| Humic Acids | 125.73 | 60.83 |
| Carbon Dioxide* | 24.65 | 11.93 |
| Acid Soluble Component** | 22.90 | 11.08 |
| Total | 206.68 | 103.34 |

*Determined as $Na_2CO_3$ by potentiometric and conductometric procedures.
**Calculated as Acetic Acid based on dissolved non-carbonate carbon determination.

Table 2

GASES OTHER THAN $CO_2$* PRODUCED WITH SODIUM HYDROXIDE DISSOLUTION OF BIG HORN COAL (GAS YIELD VOLUME APPROXIMATELY 40 ML)

| Component | mol % (Normalized) |
|---|---|
| Hydrogen | 58.27 |
| Methane | 32.48 |
| Ethane | 4.94 |
| Propane | 3.16 |
| Butane | 1.15 |
| Total | 100.00 |

*Approximately 12 percent of the moisture free sample was converted to $CO_2$ by treatment with sodium hydroxide. These results are given in Material Balance, Table 1.

Table 3

RECOVERY OF HUMUS MATERIAL FROM "5500" SODIUM HUMATE SOLUTION

| Separation Method | Humic Recovered (gram/liter) |
|---|---|
| Hydrochloric Acid | 23.04 |
| Carbonic Acid | 22.85 |
| Calcium Hydroxide | 22.70 |
| Mean | 22.86 |

Table 4

ELEMENTAL ANALYSIS OF HCl-PRECIPITATED HUMIC ACIDS FROM "5500" SOLUTION

| Element | Wt % |
|---|---|
| Carbon | 73.17 |
| Hydrogen | 5.13 |
| Nitrogen | 1.34 |
| Sulfur | 0.51 |
| Oxygen* | 16.85 |

Table 4-continued

ELEMENTAL ANALYSIS OF HCl-PRECIPITATED HUMIC ACIDS FROM "5500" SOLUTION

| Element | Wt % |
|---|---|
| Ash | 3.00 |

*Oxygen by different

Table 5

HUMIC ACIDS PRECIPITATED FROM "5505" SOLUTION WITH CARBONIC ACID

| Element | Wt % |
|---|---|
| Carbon | 72.18 |
| Hydrogen | 5.14 |
| Nitrogen | 1.33 |
| Sulfur | 0.48 |
| Oxygen* | 18.25 |
| Ash | 2.62 |

*Oxygen by difference

Table 6

HUMATES PRECIPITATED FROM "5500" SOLUTION WITH CALCIUM HYDROXIDE

| Element | Wt % |
|---|---|
| Carbon | 48.98 |
| Hydrogen | 3.72 |
| Nitrogen | 0.96 |
| Sulfur | 0.30 |
| Oxygen* | 22.28 |
| Ash** | 23.76 |

*Oxygen by different
**Ash includes calcium used to precipitate calcium humate, as well as calcium consumed in precipitating carbonate ion as $CaCO_3$.

Table 7

SPECTROCHEMICAL ANALYSIS FOR 800° C ASH FROM CALCIUM HYDROXIDE PRECIPITATED HUMATES

| Element | % |
|---|---|
| Aluminum | 1.00 |
| Barium | 0.02 |
| Boron | 0.70 |
| Calcium* | 59.70 |
| Chromium | 0.20 |
| Cobalt | 0.03 |
| Copper | 0.02 |
| Iron | 2.00 |
| Magnesium | 1.00 |
| Manganese | 0.06 |
| Molybdenum | 0.03 |
| Nickel | 0.05 |
| Silicon | 6.00 |
| Sodium* | 1.35 |
| Strontium | 0.02 |
| Titanium | 0.20 |
| Vanadium | 0.05 |

*Results by Atomic Absorption Analysis

Table 8

HEAT BALANCE FOR BIG HORN COAL SAMPLE TREATED WITH SODIUM HYDROXIDE (5461 BTU IN COAL CHARGED)

| Product | Heat of Combustion (Btu) | |
|---|---|---|
| Gases | 1 | |
| Insoluble Residue | 759 | (13.9%) |
| Humic Acids | 3,493 | (64.0%) |
| Carbon Dioxide | 0 | |
| Acid Sol. Components | 315 | (5.7%) |
| Total | 4,568 = | 83.6% |
| Loss or Unaccounted For | 893 = | 16.4% |

We claim as our invention:

1. A process for dissolving a subterranean coal formation of coal of high oxygen content which comprises contacting said coat with a heated basic aqueous solution at a temperature of from about 175° to about 250°

C. for a time sufficient to dissolve at least a portion of said coal by forming coalate solution.

2. The process of claim 1 wherein the basic aqueous solution is an aqueous sodium hydroxide solution.

3. The process of claim 1 wherein said coal is contacted in an inert environment.

4. The process of claim 1 wherein said coalate solution is removed from contact with said coal formation and said basic aqueous solution is regenerated.

5. The process of claim 1 wherein said coal is located in a coal seam which is penetrated by at least one borehole through which said heated basic aqueous solution is injected into contact with said coal.

6. The process of claim 1 wherein said coal seam is penetrated by at least two boreholes in fluid communication with each other, one of which is used to inject said heated basic aqueous solution into contact with said coal while the other is used to remove coalate from said formation after contacting said coal.

7. The process of claim 1 wherein the basic aqueous solution varies from about 0.5 percent by weight of the base to about 20 percent by weight of the base.

8. The process of claim 1 wherein the amount of base employed to dissolve the coal varies from 0.2 part to about 1 part by weight of base per part by weight of coal.

9. A process for dissolving a subterranean coal formation of coal of high oxygen content which comprises contacting coal with a heated basic aqueous solution for a time sufficient to dissolve at least a portion of said coal by forming coalate solution, and adding a strong acid, acid forming agent, base or base forming agent to said coalate to regenerate the basic aqueous solution.

10. The process of claim 9 wherein the temperature of said heated basic aqueous solution ranges from about 175° C. to about 250° C.

11. The process of claim 10 wherein after said coalate is transported to a receiving terminal and the basic aqueous solution is regenerated.

12. The process of claim 11 wherein a strong acid, acid forming agent, base, or base forming agent is added to said coalate to regenerate the basic aqueous solution.

13. The process of claim 9 wherein the acid forming agent is carbon dioxide which is bubbled into the coalate solution.

14. The process of claim 9 wherein the base is calcium hydroxide.

* * * * *